US006684566B2

(12) United States Patent
LaCook

(10) Patent No.: US 6,684,566 B2
(45) Date of Patent: Feb. 3, 2004

(54) SAFETY GATE AND GUARD FOR SUCH A GATE

(76) Inventor: David LaCook, 2012 Karbach St., Houston, TX (US) 77092

( * ) Notice: Subject to any disclaimer, the term of this patent is extended or adjusted under 35 U.S.C. 154(b) by 0 days.

(21) Appl. No.: 10/079,657

(22) Filed: Feb. 20, 2002

(65) Prior Publication Data

US 2003/0154657 A1 Aug. 21, 2003

(51) Int. Cl.[7] ..... E01F 13/00
(52) U.S. Cl. ..... 49/49; 16/250
(58) Field of Search ..... 49/49, 460, 383; 16/250, 374

(56) References Cited

U.S. PATENT DOCUMENTS 3,866,356 A 2/1975 La Cook et al.
4,290,230 A * 9/1981 Roodenbeke ..... 49/49
4,424,893 A * 1/1984 Gillet ..... 194/4
6,094,863 A 8/2000 La Cook et al.

* cited by examiner

*Primary Examiner*—Jerry Redman
(74) *Attorney, Agent, or Firm*—Law Office of Tim Cook P.C.

(57) ABSTRACT

On a spring-biased safety gate, a guard plate is mounted to a gate member with the same hardware that mounts the stop to the gate. The guard plate is preferably formed of plate metal to define a plate mounting area and a pair of guard plates that extend perpendicularly from either side of the plate mounting area. In that way, each of the pair of guard plates extends in a direction parallel to the gate a distance sufficient to shield the mounting hardware behind the guard plate and the stop.

4 Claims, 2 Drawing Sheets

SAFETY GATE AND GUARD FOR SUCH A GATE

FIELD OF THE INVENTION

This invention relates to a safety guard for incorporating in or attachment to a gate that is used to close the opening in the guard rail of a walkway and the like.

BACKGROUND OF THE INVENTION

In many industrial plants, walkways or catwalks provide access for workers to traverse from one area of the plant to another, for example to provide access to various equipment throughout the plant. Unfortunately, the walkways also provide locations from which a worker could fall to a lower level. In order to make them safer, such walkways are usually provided with guard rails to help prevent a worker from accidentally stepping off the side of the walkway and falling. For various reasons, however, it is necessary to provide openings in the guard rails. Usually, for example, one or more ladders or stairs lead from the walkway to a lower level. Openings are provided in the guard rails so that a person can move from the ladders or stairs onto the walkway and vice versa. Such openings in the guard rails are a danger to personnel using the walkway.

In U.S. Pat. No. 6,094,863, Hardy L. LaCook, Jr. taught an attachment for a safety gate that was positioned to close the opening in a catwalk to allow access to and from a ladder or stairs. The gate was urged to the closed position by biasing means, such as springs. An attachment was provided for connecting to the lower side of existing gates to prevent workmen using the catwalk from slipping under the gate and falling into the opening for stairs or a ladder.

In U.S. Pat. No. 3,866,356, LaCook et al. taught an earlier version of a safety gate for closing the openings for ladders or stairwells in the guard rails of walkways. A spring urged the gate member to rotate in one direction and a stop limited the rotation in that direction to position the gate member to close the opening. The stop was adjustable so that the gate member could be positioned as required by location of the opening relative to the guard rail.

The safety gates shown and described in the '356 and '863 patents have proved to be very successful in the marketplace. However, the stop previously described is typically constructed of an adjustable bolt, with attachment hardware, so that the position of the gate member in its quiescent position can be adjusted relative to the guard rail. The respective ends of the adjustable bolt are exposed to the exterior of the gate, and thus can snag the clothing of workers as they pass through the gate. Further, the closure of the stop means of the gate can pinch fingers and the like when the gate closes, thereby presenting another safety hazard. Thus, there remains a need for a way to eliminate this tendency of the prior art gate to snag the clothing of workers, or other loose items as they pass through such a gate.

SUMMARY OF THE INVENTION

The present invention addresses this need in the art by providing a guard plate mounted with the hardware that also mounts the stop to the gate. The guard plate is preferably formed of plate metal to define a plate mounting area and a pair of guard plates that extend perpendicularly from either side of the plate mounting area. In that way, each of the pair of guard plates extends in a direction parallel to the gate a distance sufficient to shield the mounting hardware behind the guard plate.

The guard plate serves the further function of providing a display area which may be used to include warnings and the like for workers. The display area may be painted with a highly visible paint and further include contrasting colors for warnings to enhance the safety of the safety gate.

These and other objects, advantages, and features of this invention will be apparent to those skilled in the art from a consideration of this specification, including the attached drawings and appended claims.

DESCRIPTION OF A PREFERRED EMBODIMENT

Figure 1:
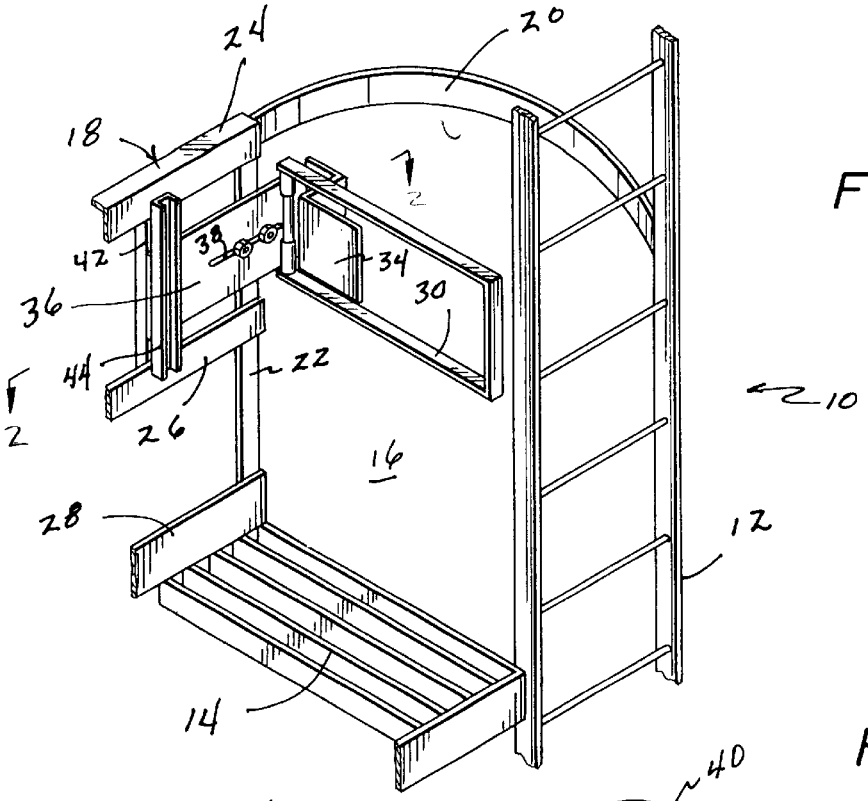
FIG. 1 is an isometric view of a gate including the safety guard of this invention.

Openings are required in guard rails for many reasons, one of the most common being to provide access to ladders and stairs, for example. FIG. 1 shows an access opening structure 10 wherein a ladder 12 is provided for personnel moving up to or down from a walkway or catwalk 14. To move between the ladder and the walkway, a person must move through an opening 16 framed by the ladder 12 on one side and a guard rail 18 on the other. An arcuate back guard 20 provides additional structural stiffness while extending the guard rail 18 to the ladder 12. The guard rail 18 is typically built like a fence with spaced-apart posts, such as a post 22, and longitudinally extending rails, such as rails 24 and 26, that extend between the posts and form a fence to help prevent personnel from falling off the side of the walkway. The guard rail usually includes a toe-plate 28 that extends between the guard fail posts just above the walkway to prevent a person's foot from slipping off the walkway between the lower rail 26 and the walkway.

The gate of this invention is depicted in FIG. 1 as extending substantially across the opening 16. The gate includes a gate member 30 and a mounting structure for mounting the gate member 30 for movement between a first shut position, thereby closing the opening, and a second position, allowing personnel to pass through the opening. In the embodiment shown in FIG. 1, the gate member 30 is generally U-shaped. A spacer plate 32 (see FIGS. 2 and 4) extends between the two legs of the gate member 30 to add rigidity to the gate member. A guard 34, in accordance with this invention, extends between the upper and lower legs of the gate member 30, and is mounted for movement with the gate member as described below. Among its many functions, the guard 34 shields mounting hardware from exposure to loose hanging items, such as clothing and it provides a placard for the display of warnings to those passing through the gate. The guard also prevents pinching of fingers and the like between the elements of the gate stop, as described below.

Figure 2:
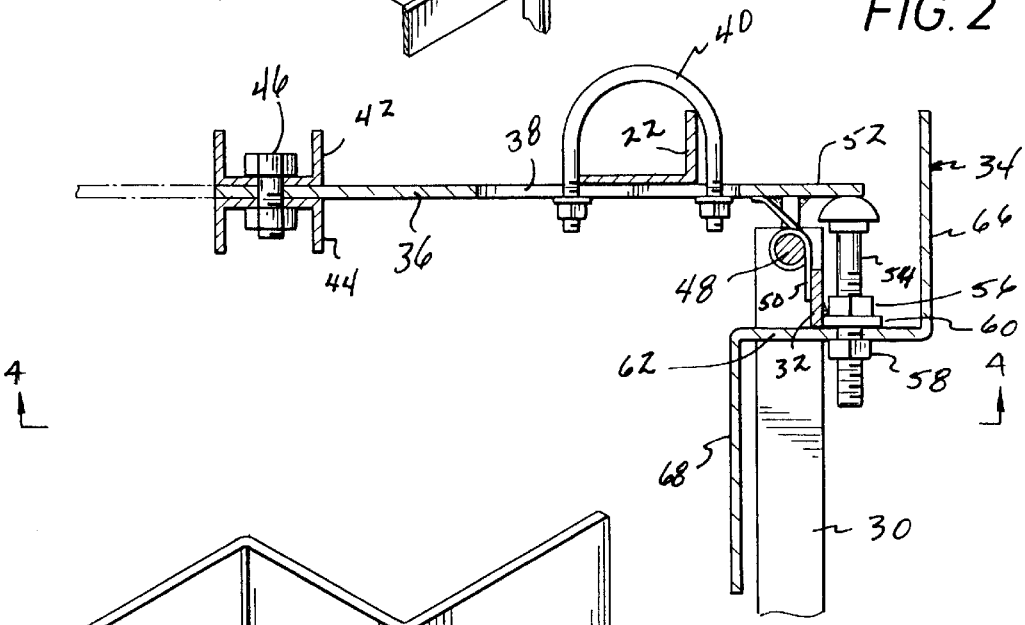
FIG. 2 is an top view of the portion of the gate of FIG. 1 showing the guard of this invention attached to the gate along with the stop. The top view of FIG. 2 is taken along section lines 2—2 of FIG. 1.

FIG. 2 illustrates the preferred embodiment of the guard of this invention and how it is preferably mounted to the guard rail 22. It will be immediately apparent to those of skill in the art that the guard rail may also extend in the same general direction as the orientation of the gate member, or other angle. The right angle between the guard rail and the gate member are only illustrative. A mounting plate 36 has an elongated opening 38 to receive threaded ends of a U-bolt 40 to clamp the mounting plate to the post 22 of the guard rail in the desired position above the walkway 14. To provide more rigidity to the support for the gate, channels 42 and 44 are pulled together on opposite sides of the vertical flanges of the rails 24 and 26 by bolts 46 to clamp the plate to the rails at a point spaced from the U-bolt 40.

A biasing member is provided to rotate the gate member in one direction around its pivotal axis provided by a shaft 48. In the embodiment shown, a spring 50 is coiled around the shaft 48 with its ends in engagement with the mounting plate 36 and the spacer plate 32 of the gate member. The spring is designed to urge the gate member to pivot in a counterclockwise directions, as viewed in FIG. 2, but to allow the gate member to be forcibly moved in a clockwise direction to move out of its position obstructing the opening 16 to allow personnel to move through the opening. A stop is provided to stop the rotation of the gate member in the counterclockwise direction when the gate member is in position to close the opening 16 to personnel on the walkway 14.

Figure 3:
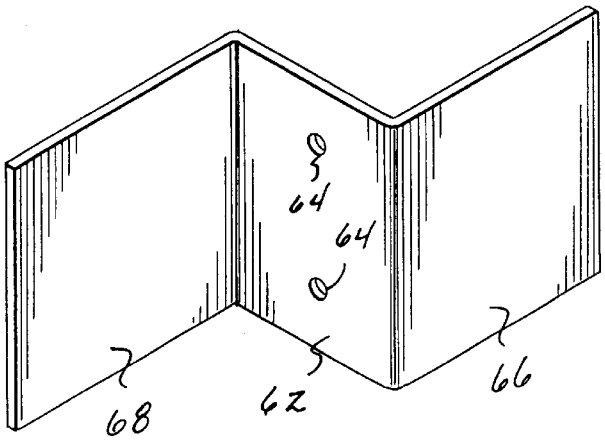
FIG. 3 is an isometric view of the guard of this invention.
Figure 5:
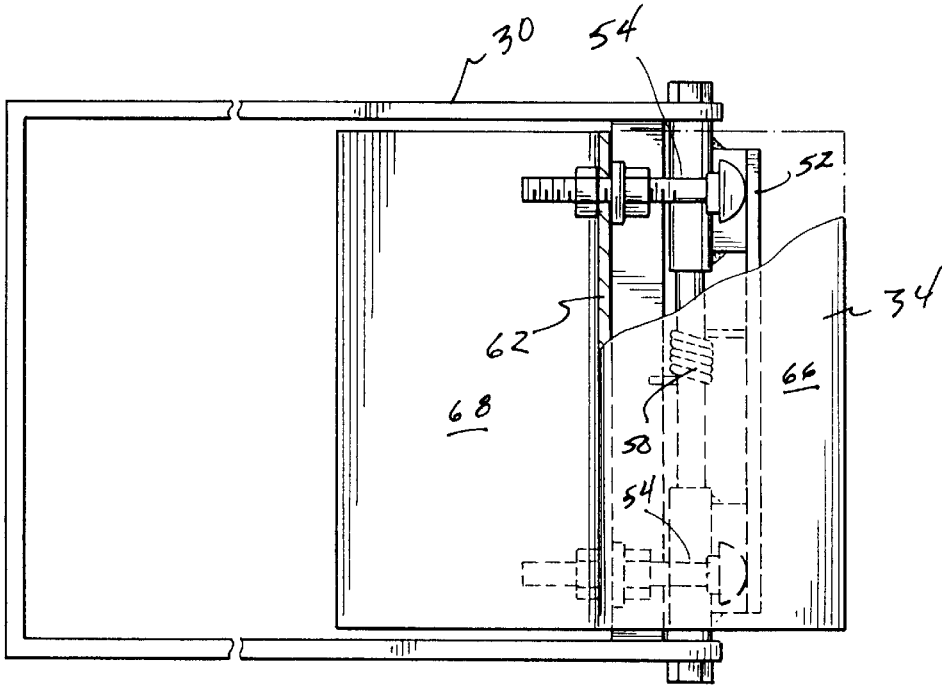
FIG. 5 is a front view of a portion of the gate including a partial cutaway view of the guard.

The stop comprises a portion 52 of the mounting plate 36 extending laterally a sufficient distance to contact a bolt 54 mounted on the gate member by nuts 56 and 58 and by a washer 60, joined to the spacer plate 32. The guard 34 of the present invention is also attached to the gate member 30 by means of the bolt 54 and the nuts 56/58 and the washer 60, thereby requiring no additional mounting hardware. It should be understood that the gate assembly preferably includes two such stops, displaced apart vertically from one another, as shown in FIG. 5. The guard 34 includes a transverse portion 62 with mounting holes 64 (see FIG. 3); an outer portion 66; and an inner portion 68; all formed as an integral unit. The outer member 66 extends laterally to a point beyond the portion 52, thereby eliminating the possibility of catching clothing and the like, or from pinching fingers and the like in the stop. The inner portion preferably extends laterally by the same distance, so that the guard 34 can be assembled in either direction for ease of assembly.

Figure 4:
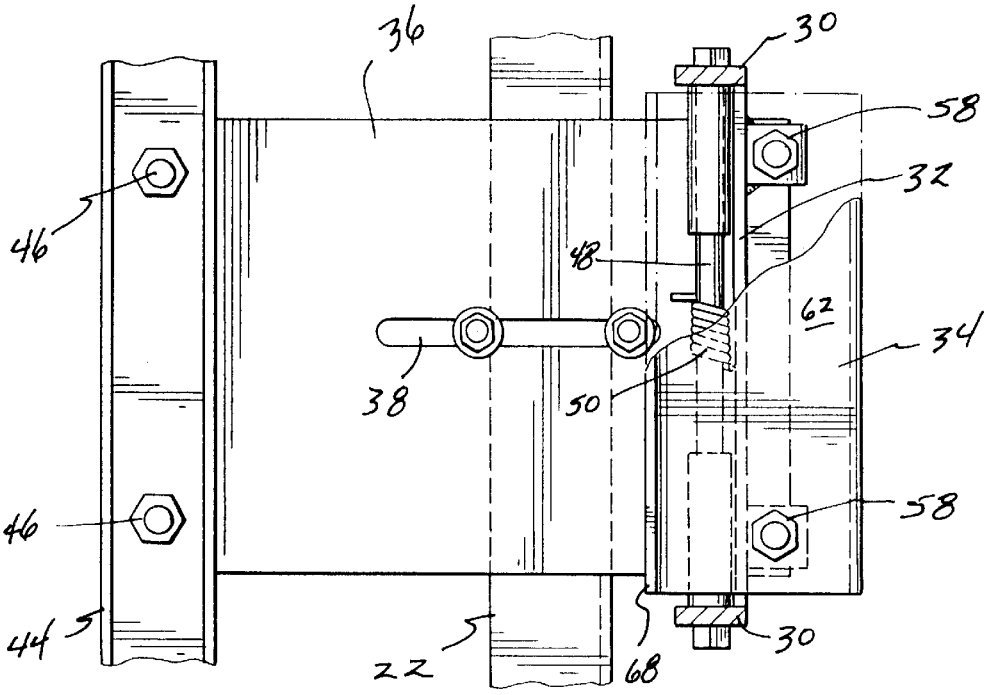
FIG. 4 is a side view of a portion of the gate including a partial cutaway view of the guard. The side view of FIG. 4 is taken along section lines 4—4 of FIG. 2.

The orientation of the various components just described is shown in FIGS. 4 and 5 in elevation views. The guard member 34 is preferably mounted to the gate member 30 with the bolts 54 that also serve as stops when the abut the portion 52 of the mounting plate. The outer member 66 thereby extends beyond the portion 52 so that the abutment between the bolts 54 and the portion 52 is shielded. Thus, no clothing can the snagged by the mounting hardware, and the pinching hazard of the stop is eliminated.

It will be understood that certain features and subcombinations are of utility and may be employed without reference to other features and subcombinations. This is contemplated by and is within the scope of the claims. Because many possible embodiments may be made of the invention without departing from the scope thereof, it is to be understood that all matter herein set forth or shown in the accompanying drawings is to be interpreted as illustrative and not in a limiting sense.

I claim:

1. A safety gate for closing the opening in a guard rail, the gate comprising:

a. a gate member;

b. mounting hardware to pivotably mount the gate member to the guard rail, the mounting hardware including a stop, the stop including an adjustable bolt having a biased position in contact with the guard rail; and c. a guard plate mounted to the gate member, the guard plate defining a laterally extending outer plate portion extending from a point along the gate member to a point beyond the stop and the guard rail.

2. The safety gate of claim 1, wherein the guard plate is mounted to the gate member with the mounting hardware.

3. The safety gate of claim 1, wherein the guard plate further comprises a mounting plate portion extending through the gate member.

4. The safety gate of claim 1, wherein the guard plate further comprises an inner plate portion extending the same distance as the outer plate portion.

* * * * *